US006048217A

United States Patent [19]

Kobayashi

[11] Patent Number: 6,048,217

[45] Date of Patent: Apr. 11, 2000

[54] CONNECTING DEVICE FOR HIGH-VOLTAGE CABLE

[75] Inventor: Yoshinao Kobayashi, Yokkaichi, Japan

[73] Assignee: Sumitomo Wiring Systems, Ltd., Yokkaichi, Japan

[21] Appl. No.: 08/969,540

[22] Filed: Nov. 13, 1997

[30] Foreign Application Priority Data

| | | | |
|---|---|---|---|
| Nov. 15, 1996 | [JP] | Japan | 8-304691 |
| Nov. 15, 1996 | [JP] | Japan | 8-304692 |
| Nov. 15, 1996 | [JP] | Japan | 8-304693 |

[51] Int. Cl.[7] ..... H01R 13/44

[52] U.S. Cl. ..... 439/125

[58] Field of Search ..... 439/125–128

[56] References Cited

U.S. PATENT DOCUMENTS

| | | | |
|---|---|---|---|
| 4,443,047 | 4/1984 | Hofman . | |
| 5,332,394 | 7/1994 | Frost | 439/125 |
| 5,348,486 | 9/1994 | Tura, Jr. et al. | 439/125 |
| 5,630,722 | 5/1997 | Mochizuki et al. | 439/125 |

*Primary Examiner*—Gary F. Paumen

*Attorney, Agent, or Firm*—Greenblum & Bernstein, P.L.C.

[57] ABSTRACT

An L-shaped plug connection for connecting a high-voltage cable to a spark plug includes a socket terminal having a tubular cable-connecting portion having an inner diameter and a semi-tubular plug connecting portion being provided in a perpendicular direction to the cable-connecting portion and having an open end zone. The end zone has a wall thickness, a pair of opposed rim portions, and an intermediate cavity portion being provided therebetween and having a predetermined dimension in the transverse direction of the cable-connecting portion. The socket terminal also includes a C-shaped elastic ring and an elastomeric boot having an L-shaped cavity which includes at least an inner face facing an outer face of the cable-connecting portion and a projecting inside corner being provided at the intersection between the intermediate cavity portion and the rim portions and leaving a gap therebetween. The plug connection further includes a plug-guiding arrangement enabling smooth fitting to, and removal from, the spark plug.

16 Claims, 11 Drawing Sheets

CONNECTING DEVICE FOR HIGH-VOLTAGE CABLE

BACKGROUND OF THE INVENTION

1. Field of the Invention

The present invention relates to a connecting device for high-voltage cables used in internal combustion engines of, for example, automobiles, etc. More particularly, the invention is used to connect a spark plug to a high-voltage cable extending from an ignition coil or a distributor in an internal combustion engine.

2. Description of Background Information

Such an electrical connecting device, a plug connection, an ignition coil or distributor connection are known, and the plug connection may have, for example, the structure shown in FIG. 1. One such example is described in U.S. Pat. No. 5,348,486, issued on Sep. 20, 1994.

The above plug connection comprises a socket terminal 2 made of stainless steel or other similar materials. At one end, the socket terminal 2 is electrically connected to the high-voltage cable 1. The plug connection further comprises a flexible elastomeric boot 3 made of an insulating and elastic material such as silicone rubber, for housing the socket terminal 2.

The socket terminal 2 comprises, at one end, a cable-connecting portion 2*a* in which the high-voltage cable 1 is inserted and pressed by the cable connecting portion to ensure electrical connection. At the other end, a plug-connection portion 2*b* receives the head portion 5*a* of the spark plug 5, which is inserted and plugged therein from a direction perpendicular to the axis of the cable-connecting portion 2*a*. The head portion 5*a* of this spark plug 5 has a shape similar to a bulb.

An intermediate portion of the socket terminal between the cable-connection portion 2*a* and the plug-connecting portion 2*b* forms a constricted portion 2*c* which has a narrower width.

The plug-connecting portion 2*b* comprises a plug-side socket opening 2*d*, into or from which the head portion 5*a* can be plugged or unplugged, and a C-shaped elastic ring 2*e* cooperating with the plug-side socket opening 2*d*.

The plug-side socket opening 2*d* has a pair of holes (not shown in the figures), provided at substantially opposed positions.

The elastic ring 2*e* includes, at each end thereof, a pair of projections 2*f* which project inwardly, as shown in FIG. 5.

When the ring 2*e* is fitted around the plug-side socket opening 2*d* from outside, each projection 2*f* is snapped into the corresponding hole of the plug-side socket opening 2*d*. Thus, the ring 2*e* is fixed around the plug-side socket end with each projection 2*f* projecting inwardly.

The elastomeric boot 3 is formed in an L-shape and comprises a terminal container 3*a* for housing the socket terminal 2, an opening 3*b* for receiving the high-voltage cable 1 therein, and a plug-receiving portion 3*c*, through which the head 5*a* of the plug is guided.

FIG. 1 shows a process in which the elastomeric boot 3 is connected to the spark plug 5 installed in an engine via the head portion 5*a*. In this construction, the projections 2*f* of the elastic ring 2*e* are fitted into the neck 5*b* adjacent to the head 5*a*, so that the spark plug is prevented from being released.

However, the plug connections of the prior art have drawbacks when the spark plug 5 is inserted therein, as shown, for example, in FIG. 2. When the spark plug is inserted in an oblique position relative to the axis of the plug-receiving portion 3*c*, the edge of the head portion 5*a* may abut against the rim of the plug-side socket opening 2*d* or be hooked thereby, so that the head portion 5*a* is not snugly installed therein or cannot be installed therein.

Further, the elastomeric boot 3 is deformable and expandable due to its elasticity. As shown in FIG. 3, the elastic deformation tends to increase the area of the region where the head portion 5*a* and the rim of the plug-side socket opening 2*d* come into contact, thereby further worsening the fittability.

FIG. 4 shows the case when the elastic ring 2*e* is tightly set. When the socket terminal 2 is removed from the spark plug 5 in such a case, the socket terminal 2 may be inadvertently bent inside the elastomeric boot. Then, a great force is required to remove the head portion from the socket terminal. When forcibly removed, this may cause deformations of the socket terminal 2, as shown in FIG. 5.

Likewise, the known elastomeric boot is bent into an L-shape, so that the inside corner 3*d*, located between the terminal container 3*a* for housing the socket terminal and the plug-receiving portion 3*c* for introducing the plug, forms a semi-circle.

In the above construction, when the spark plug is inserted in an oblique direction in the plug-receiving portion 3*c* as shown in FIG. 6, the head portion 5*a* of the spark plug 5 may be caught by the constricted portion 2*c* of the socket terminal 2. Then, the head portion cannot be placed correctly, but lies in the constricted portion, as shown by dotted lines in FIG. 7.

Furthermore, the constricted portion 2*c* of the socket terminal has a relatively deep cut-away portion extending from the periphery towards the axis of the socket terminal 2, as shown in FIGS. 1 and 6. In addition, the inside corner portion 3*d* has a round shape. In such a case, when removing the socket terminal 2 from the plug, the socket terminal 2 tends to tilt inside the boot 3, due to a strong fitting force of the elastic ring 2*e*. This phenomenon may be worsened by an unstable fixing of the socket terminal 2 inside the terminal container 3*a*, and eventually, by a deformation of the socket terminal 2. Also, a strong releasing force is required for removal of the plug connection from the spark plug (FIG. 4). When the spark plug is forcibly removed, the socket terminal 2 may be deformed as shown in FIG. 5.

Also, in the known plug connection of FIGS. 1 to 6, the opposed rim portions of the plug-side socket opening 2*d*, which are spaced-apart from one another at the open side of the elastic ring 2*e*, are also separated from the inside corner 3*d* of the socket terminal 2. Moreover, the separation between the rim portions is rather large at the open side of the elastic ring and, further, increases from the closed end of the plug-connecting portion towards the opening 2*d* thereof.

Therefore, as shown in FIG. 6, when the plug is introduced in an oblique direction through the plug passage 3*c* of the boot 3, the head portion 5*a* of the spark plug may be inadvertently caught by the constricted portion 2*c* of the socket terminal 2. The head portion 5*a* may then not be fitted properly into the plug-connecting portion 2*b*, as shown by the dotted line in FIG. 7.

SUMMARY OF THE INVENTION

It is therefore a purpose of the present invention to provide a device for connecting a high-voltage cable to a spark plug or the like, which device improves the fitting operation of the plug into, or the removal operation from the socket terminal.

To this end, the present invention includes an L-shaped plug connection for connecting a high-voltage cable to a spark plug. This plug connection includes a socket terminal having a tubular cable-connecting portion having an inner diameter, a semi-tubular plug connecting portion extending in a perpendicular direction to the cable-connecting portion and having an open end zone. The end zone has a wall thickness and a pair of opposed rim portions. The device further comprises an intermediate cavity portion being provided between the cable-connecting portion and the plug-connecting portion which has a predetermined dimension in the transverse direction of the cable-connecting portion, and a C-shaped elastic ring.

An elastomeric boot has an L-shaped cavity which includes at least an inner face facing an outer face of the cable-connecting portion and a projecting inside corner being provided at the intersection between the intermediate cavity portion and the rim portions and leaving a gap therebetween.

This plug connection further comprises a plug-guiding arrangement being configured to enable smooth fitting to, and removal from, the spark plug.

According to a first embodiment, the plug-guiding arrangement comprises a channel in the inner face of the L-shaped cavity at the position corresponding to the position of the elastic ring, whereby the channel receives the elastic ring and further comprises a space sufficient to contain the elastic ring when it is expanded.

The plug-guiding arrangement may further comprise a recess provided in the inner face of the L-shaped cavity at a position corresponding to the position of the open end zone, whereby the recess receives the wall thickness of the open end zone.

According to a third embodiment, the plug-guiding arrangement may comprise the intermediate cavity portion in which a predetermined dimension is sufficiently great such that there is substantially no gap between the intermediate cavity portion and the projecting inside corner.

Advantageously, the predetermined dimension of the intermediate cavity portion is substantially the same length as the inner diameter of the cable-connecting portion.

According to a fourth embodiment, the projecting inside corner may substantially form a right angle.

According to a fifth embodiment, the plug-guiding arrangement may comprise a further plug-guiding arrangement having the pair of opposed rim portions which approach closer to each other in the direction of the projecting inside corner. Advantageously, the pair of opposed rim portions may contact each other near the position of the projecting inside corner.

BRIEF DESCRIPTION OF THE DRAWINGS

The above and the other features and advantages of the present invention will be made apparent from the following description of the preferred embodiments, given as non-limiting examples, with references to the accompanying drawings, in which.

DETAILED DESCRIPTION OF THE PREFERRED EMBODIMENTS

The first embodiment of the present invention is described with reference to FIGS. 8 to 12. In this embodiment, the tubular socket terminal 11, used for a high-voltage cable 12, is made of stainless steel or other materials and is appropriately formed by bending as mentioned in the prior art. The socket terminal 11 has two end portions. At one end, there is provided a cable-connecting portion 11*a* into which the high-voltage cable 12 is inserted and pressed to ensure electrical contact. At the other end, there is provided a semi-tubular plug-connecting portion 11*b* for connection to the head portion of the spark plug 5. The head portion 5*a* of the spark plug has a shape similar to a bulb and can be plugged into the plug connecting portion 11*b* along the direction perpendicular to the axis of the cable-connecting portion 11*a*. Between the cable-connecting portion 11*a* and the plug-connecting portion 11*b*, there is provided an intermediate cavity portion 11*c* having a narrower width.

Figure 12:
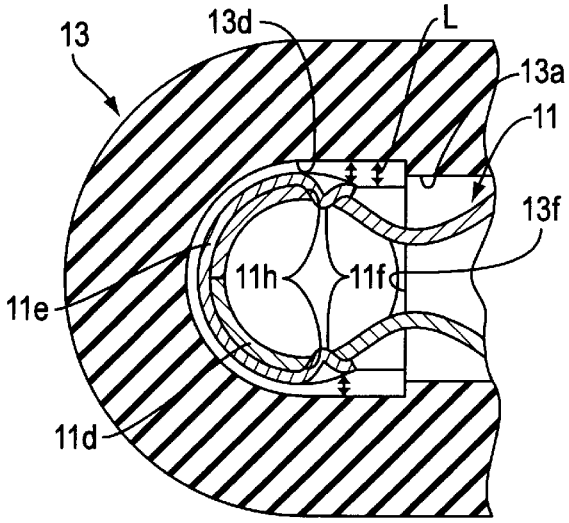
FIG. 12 shows a cross-sectional view of the plug connection taken along line XII—XII of FIG. 8.

The plug-connecting portion 11*b* comprises, as in the prior art, a pair of holes 11*h* located in substantially diametrically opposed positions in the circumferential direction thereof (see FIG. 12). There is also provided an open end zone 11*d* into which head portion 5*a* can be plugged and fitted in a retractable manner. There is further provided a C-shaped elastic ring 11*e* having a pair of projections 11*f* located on each end region thereof and projecting inwardly.

When the elastic ring lie is fitted around the open end zone 11*d*, each projection 11*f* is engaged with the corresponding hole 11*h* of the open end zone 11*d* and each projection 11*f* then projects inwardly in the open end zone.

The elastomeric boot 13 is made of a flexible and insulating material such as silicone rubber or any other elastic and insulating material and has an approximately L-shape. Elastomeric boot provides an L-shaped cavity therein and houses the socket terminal 11 in its L-shaped cavity. Boot 13 comprises a terminal container 13*a* for housing the socket terminal and a cable passage 13*b* for receiving the high-voltage cable 12. Boot 13 further comprises a plug passage 13*c* for receiving the spark plug 5 whose head portion 5*a* has the shape of a bulb. This plug is guided and received into the plug-connecting portion 11*b* via the open end zone 11*d*.

Figure 8:
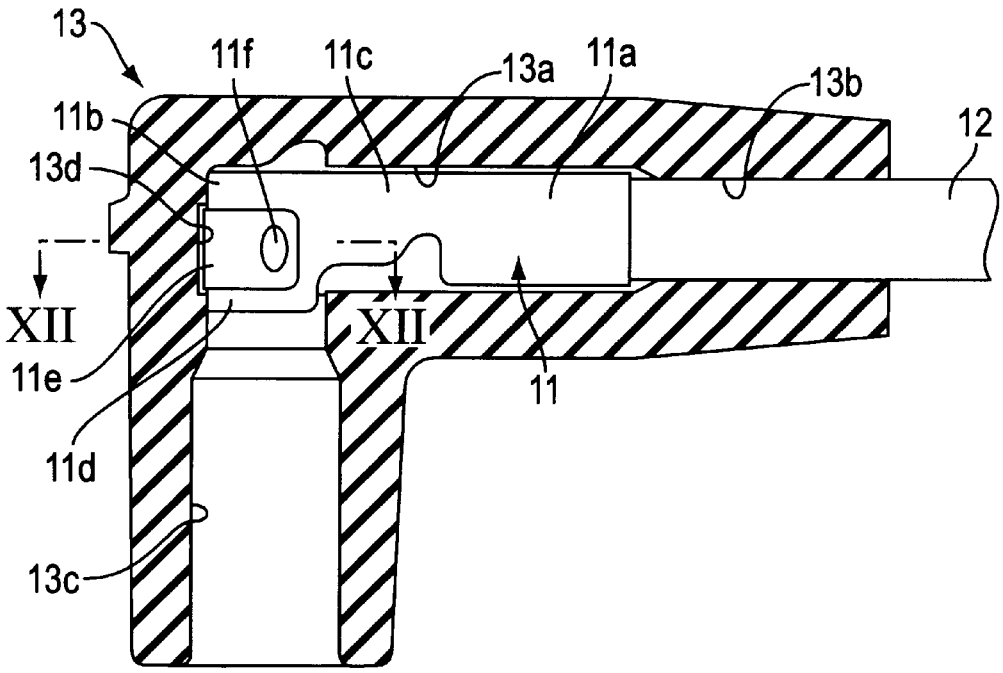
FIG. 8 shows a side-elevational view of a first embodiment of the present invention when the socket terminal and the cable are connected in the elastomeric boot.

The terminal container 13*a* has an elongated form corresponding to the shape of the socket terminal 11. According to a first embodiment of the invention, there is provided, on the internal circular surface of the terminal container 13*a*, a channel 13*d* for accommodating the elastic ring 11*e*, as shown in FIG. 8. This channel 13*d* is located at a position corresponding to that of the elastic ring 11*e* and has an appropriate depth L (FIG. 12), such that, when the head portion 5*a* is fitted into the open end zone 11*d* and the elastic ring is expanded, the channel 13*d* provides a necessary clearance.

The plug passage 13*c* has an internal diameter, at its inner end, approximately the same size as the external diameter of the open end zone 11*d*.

In this embodiment, the high-voltage cable 12 is inserted and pressed into the cable-connecting portion 11*a* of the socket terminal 11 and is electrically connected therewith. The socket terminal 11 is housed and maintained inside the terminal container 13*a* of the elastomeric boot 13. As in the prior art, the assembly thus forms a plug connection. In this state, the elastic ring 11*e* fitted around the plug connecting portion 11*b*, is placed in the channel 13*d*.

Also, when the head portion 5*a* of the spark plug 5 is introduced through the plug passage 13*c* of the elastomeric boot 13, the elastic ring 11*e* is enlarged and elastically deformed by the head portion 5*a*. Thereafter, when the projections 11*f* are fitted within the neck portion 5*b*, which is configured between the head portion 5*a* and the trunk portion of the spark plug 5, the ring 11*e* recovers its initial shape. The head portion 5*a* is thus securely held in the plug-connecting portion 11*b* of the socket terminal 11.

As described above, when the head portion 5*a* is plugged into the plug-connecting portion 11*b*, the elastic ring lie is fitted into the channel 13*d*. Accordingly, only the wall thickness of the open end zone 11*d* projects inwardly from the internal circular surface of the plug passage 13*c*. Thus, even if the spark plug is inserted in an oblique direction as occurred in the prior art, the head portion 5*a* is prevented from abutting or hooking against the plug-connecting portion 11*b*. Also thanks to its bulb shape, the head portion 5*a* of the spark plug is easily fitted into the open end zone 11*d*, thereby improving the fitting operation.

Further, the channel 13*d* provides a clearance to allow the elastic ring 11*e* to become enlarged. Because of this configuration, the ring 11*e* is smoothly elastically deformed, thereby also improving the fitting operation.

Alternatively, when the socket terminal 11 is removed from the spark plug, this channel-ring configuration effectively prevents inadvertent inclination of the socket terminal 11 and keeps the socket terminal in the right position in the terminal container 13*a*. Without any excessive force being applied, the socket terminal 11 is easily released and its deformation is effectively prevented, thus improving releasing operation.

Also due to the provided clearance, when the elastic ring 11*e* is enlarged in the channel 13*d*, the ring 11*e* is elastically and smoothly deformed and the removal operation is easily undertaken.

Figure 13:
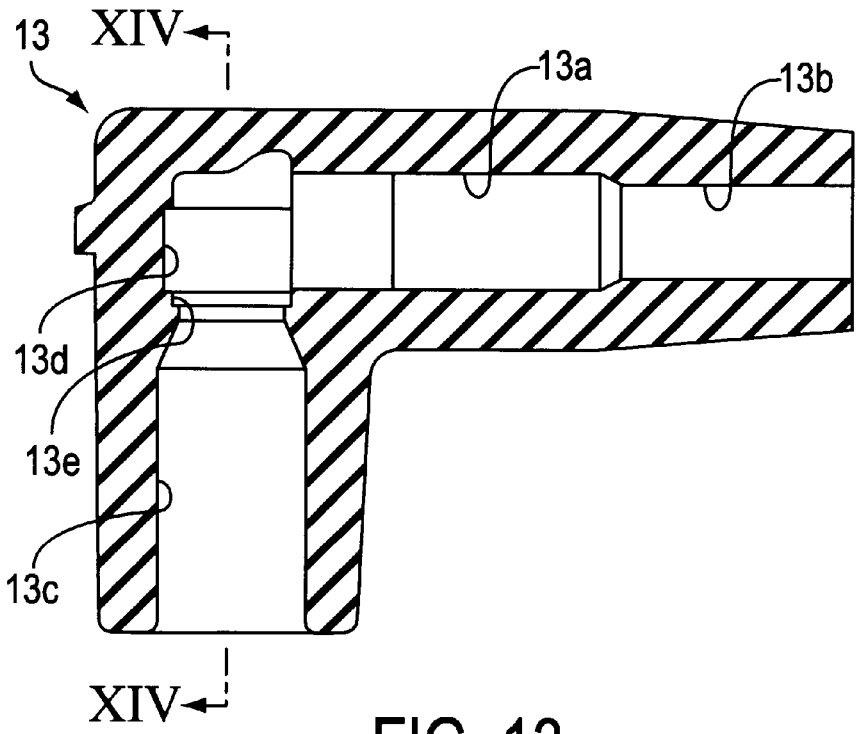
FIG. 13 shows a lateral cross-section of the elastomeric boot according to a second embodiment of the present invention.
Figure 14:
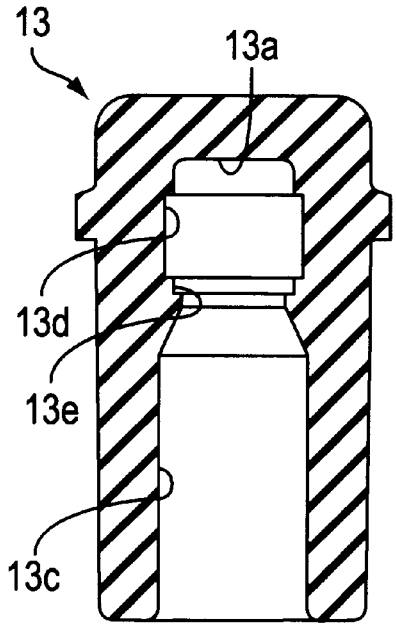
FIG. 14 shows a cross-sectional view of the elastomeric boot taken along line XIV—XIV of FIG. 13.

FIGS. 13 and 14 show a second embodiment of the present invention in which the same reference numbers are used for the same structural elements as in the first embodiment.

This second embodiment also includes the terminal container 13*a* and the socket terminal 11 having the open end zone 11*d*. The inner surface of the terminal container 13*a* is provided with a recess 13*e* at the position corresponding to the outer surface of the open end zone 11*d*. Likewise, the recess 13*e* is provided with a channel 13*d*, as in the first embodiment, at the position corresponding to the outer surface of the elastic ring 11*e*, so that open end zone 11*d* and the ring 11*e* are smoothly fitted into the recess 13*e* and the channel 13*d*.

In the second embodiment, this channel 13*d* is also provided with an appropriate depth L, so as to provide a clearance when the head portion 5*a* is fitted through into the open end zone 11*d* and the elastic ring 11*e* is enlarged.

In this second embodiment, there is practically no protruding portion inside the plug passage 13*c*. Thus, even if the spark plug is inserted in an oblique direction, as in the prior art, the head portion 5*a* is prevented from abutting against or clogging the socket terminal. This improves the operation during plugging.

Further, as a clearance is provided when the elastic ring is enlarged into the channel 13*d*, the ring 11*e* is elastically smoothly deformed. Thus, the fitting operation is easily performed.

When the socket terminal 11 is removed from the spark plug 5, as the open end zone 11*d* is fitted into the recess 13*e* and the elastic ring 11*e* is received in channel 13*d*, inadvertent inclination of the socket terminal 11 is efficiently avoided and the removal operation is improved.

Further, when removing the socket terminal 11, the elastic ring 11*e* is enlarged into the channel 13*d*. As a clearance is provided therein, the ring 11*e* is elastically smoothly deformed. The removal operation is thus very easy.

According to a third embodiment of the present invention, shown in FIGS. 15 to 18, the intermediate cavity portion 11*c* has a vertical dimension S in the transverse direction of the cable-connecting portion 11*a*. This dimension S is substantially similar to the diameter of the cable-connecting portion

11*a,* and the distance is rather long compared with that of the intermediate cavity portion 2*c* of the prior art.

Figure 15:
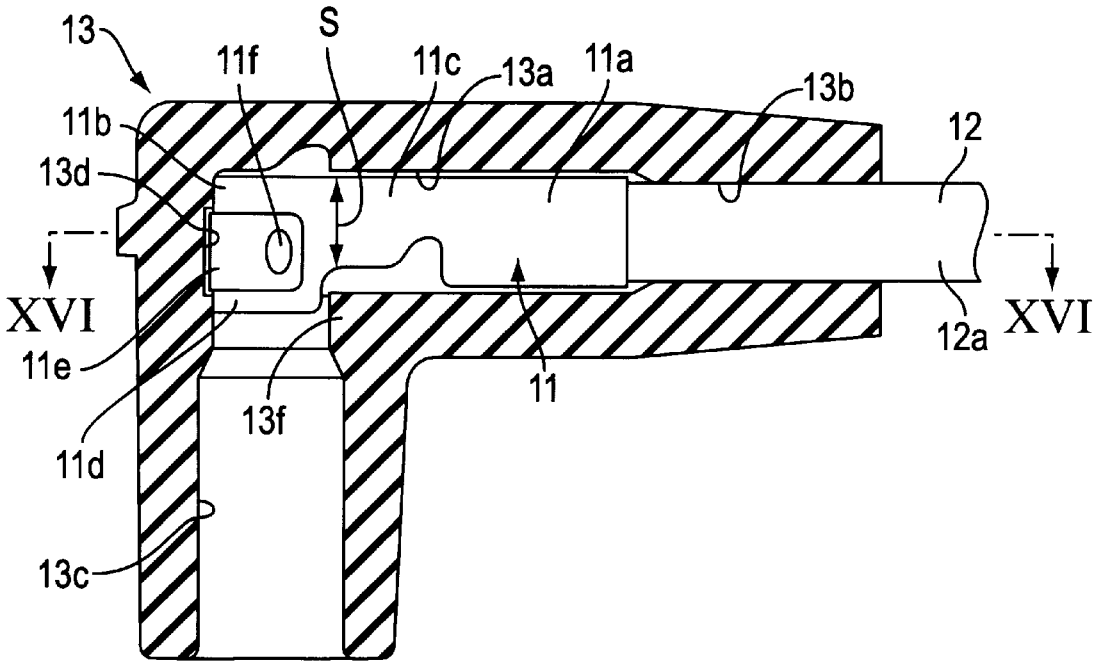
FIG. 15 shows a side-elevational view of third embodiment.
Figure 16:
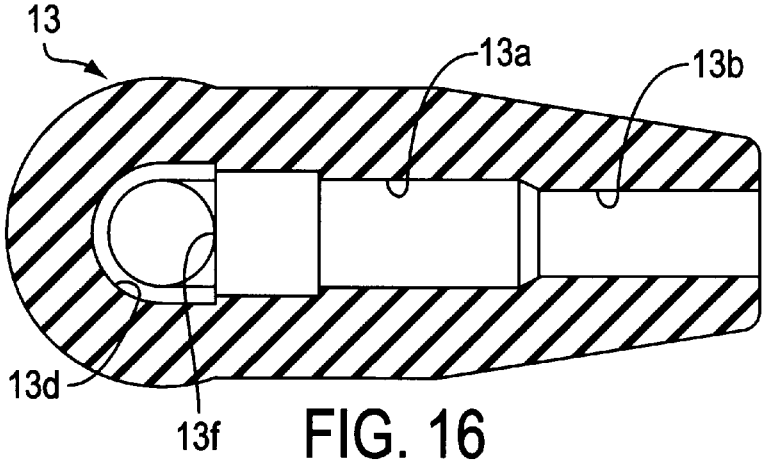
FIG. 16 shows a cross-sectional view of the elastomeric boot of FIG. 15 taken along line XVI—XVI.
Figure 17:
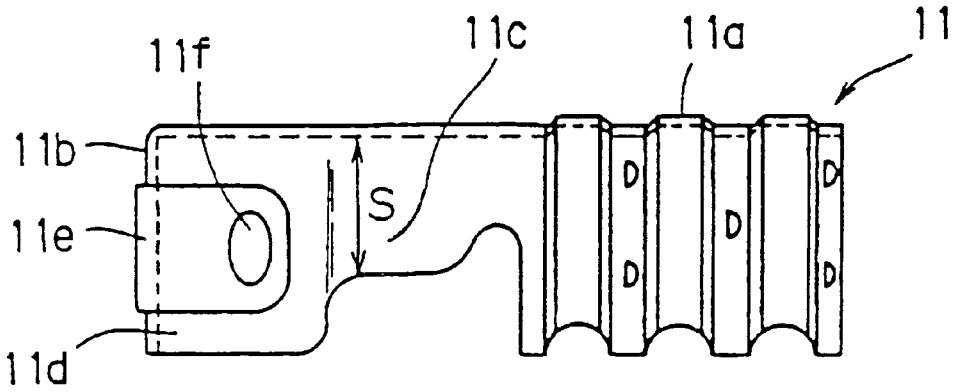
FIG. 17 shows the socket terminal according to the third embodiment of the present invention.
Figure 18:
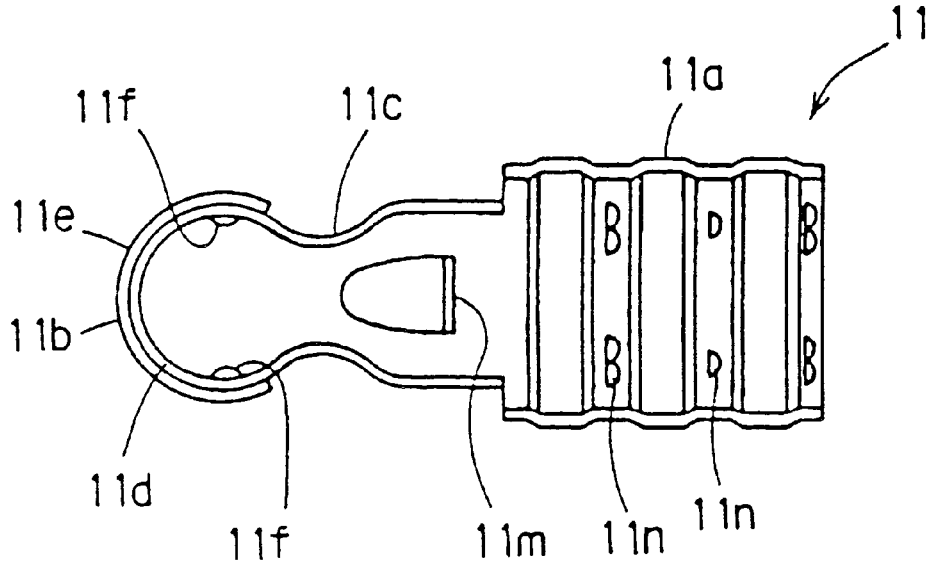
FIG. 18 shows a bottom plan view of the socket terminal of FIG. 17.
Figure 19:
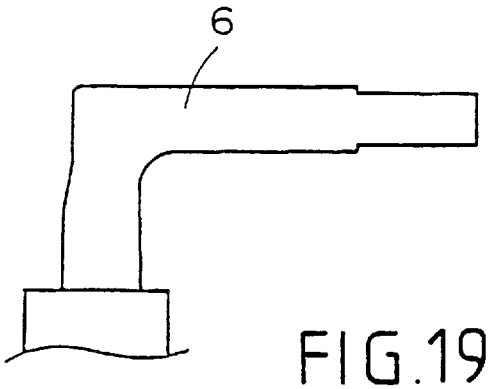
FIG. 19 shows an example of a central element used for manufacturing a known elastomeric boot.

On the other hand, as seen in FIGS. 15 and 16, the inside corner 13*f* of the elastomeric boot 13 bordering between the terminal container 13*a* and the plug passage 13*c* has a substantially right angle edge. Due to the length S of the intermediate cavity portion 11*c* and/or the substantially right angle edge of the inside corner 13*f*, there is practically no gap between the intermediate cavity portion and the inside corner 13*f*. Thanks to this structure, even if the plug 5 is inserted in an oblique direction, it is guided towards the open end zone 11*d* by this inside corner 13*f*. Clogging of the plug in the void of the intermediate cavity portion 11*c* is thus effectively avoided.

Moreover, thanks to this configuration, the socket terminal 11 is effectively prevented from inadvertent tilting and kept properly in the terminal container 13*a*. This helps to avoid an excessive application of force when removing the socket terminal 11 from the head portion 5*a*. Consequently, the socket terminal is properly maintained inside the boot 13 and the head portion 5*a* of the spark plug is easily removed from the socket terminal 11 and their deformation is effectively avoided.

This configuration, when combined with the provision of channel 13*d* and/or recess 13*e* for the elastic ring 11*e* and/or for the open end zone 11*d* respectively, further improves the proper containment of the socket terminal 11 in the terminal container 13*a*.

Figure 9:
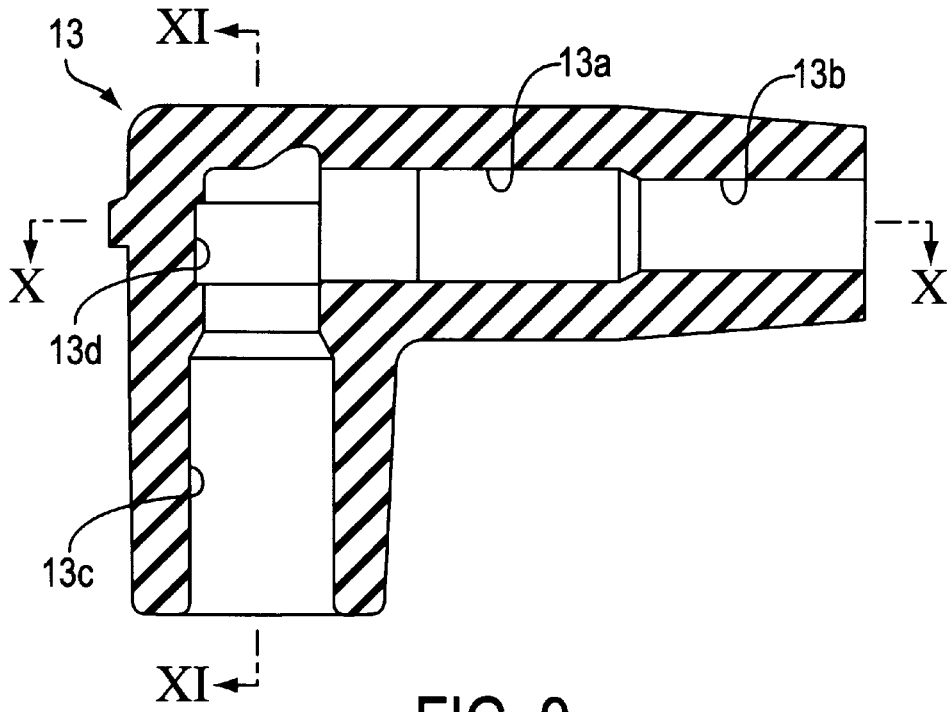
FIG. 9 shows a lateral cross section of the elastomeric boot according to the first embodiment represented in FIG. 8.

Further, the inside corner 13*f* of the boot 13, provided at the intersection of the terminal container 13*a* and the plug passage 13*c*, forms, as shown in FIGS. 8 and 9, a substantially right-angle edge, viewed in cross section (fourth embodiment). The edge may also have an angle more or less deviated from the right angle.

The presence of the right-angle inside corner 13*f* alone produces similar effects as those obtained with the above-described intermediate cavity portion 11 having a greater length S.

It is also possible to combine both of the above arrangements.

Figure 10:
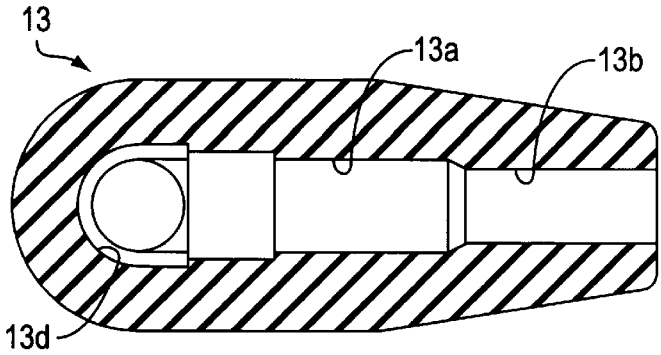
FIG. 10 shows a cross-sectional view of the elastomeric boot taken along line X—X of FIG. 9.
Figure 11:
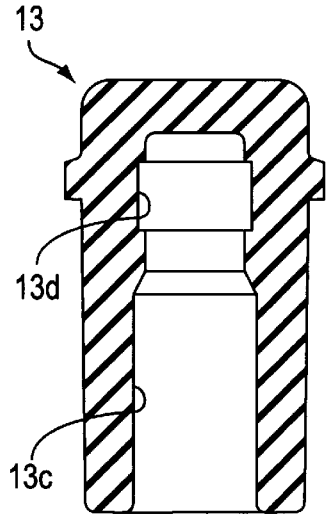
FIG. 11 shows a cross-sectional view of the elastomeric boot taken along line XI—XI of FIG. 9.
Figure 20:
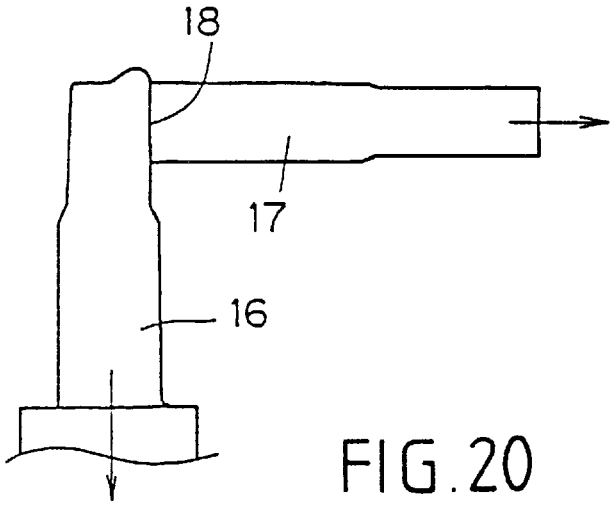
FIG. 20 shows an example of the central elements used to manufacture the elastomeric boot of the present invention.
Figure 21:
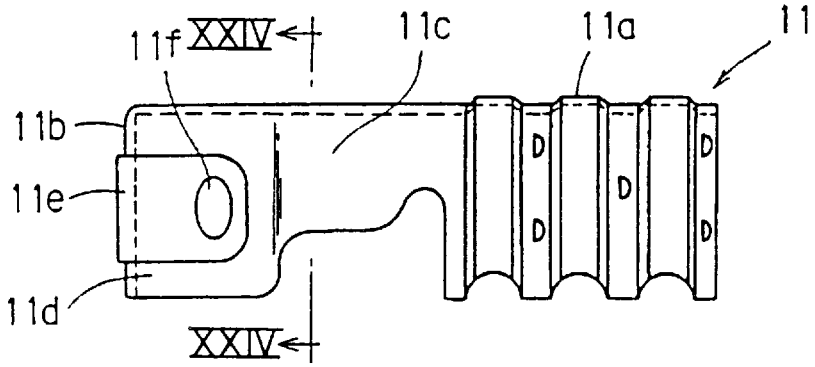
FIG. 21 shows a side view of the socket terminal used for the fourth embodiment.
Figure 22:
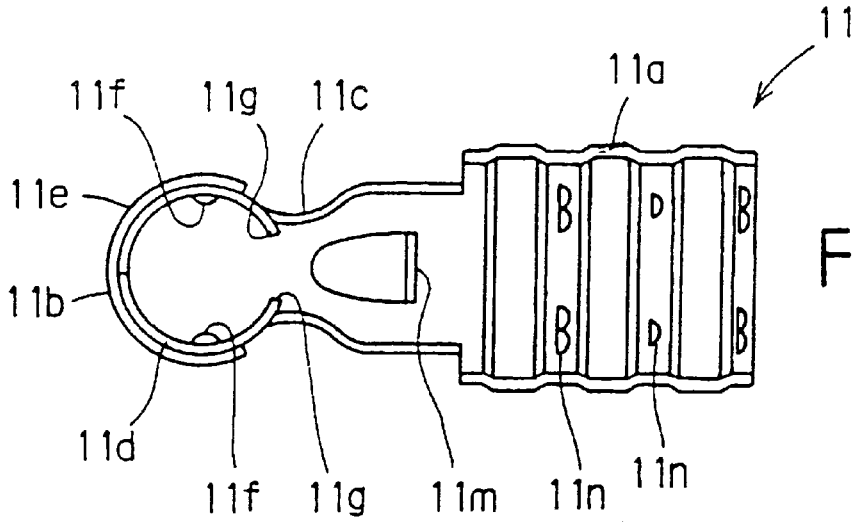
FIG. 22 shows a bottom plan view of the socket terminal of FIG. 21.
Figure 23:
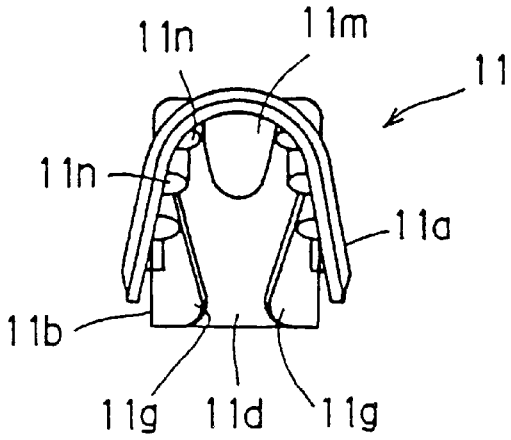
FIG. 23 shows a cross-sectional view in the direction of the plug connecting portion from the intermediate cavity portion.
Figure 24:
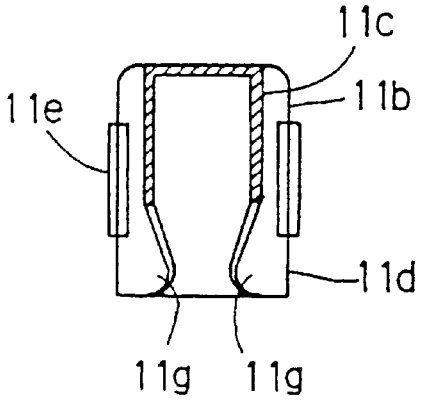
FIG. 24 shows a cross-sectional view of the socket terminal taken along line XXIV—XXIV of FIG. 21.

The inside corner having a substantially right angle also provides an advantage. To manufacture the known elastomeric boot 3, a central molding element 6 is formed of an essentially L-shaped integral element, as shown in FIG. 10. After molding, the central element 6 has to be withdrawn from the boot 3 in a forced manner. In comparison, the elastomeric boot 13 of the present invention may have a right angle inside corner 13*f*. The integral center element 6 may therefore by made by connecting a first part 16 and a second part 17 at a binding zone 18, as shown in FIG. 20. After molding, the first part 16 and the second part 17 are withdrawn from the elastomeric boot 13 in the different directions along the arrows shown in FIG. 20. As a result, the central element 6 is easily withdrawn and manufacturing of the elastomeric boot can be automated.

Further, in a socket terminal according to the embodiment of the invention shown in FIGS. 21 to 24, the opposed rim portions, located at the open end zone 11*d* and at the open side of the elastic ring 11*e,* are so configured that they form wing-like flanges 11*g*. These flanges extend more at the open end zone 11*d* than at the closed side of the plug connecting portion 11*b,* in the circumferential direction of the plug-connecting portion 11*b*. In this construction, the rim portions located at the closed side of the plug-connecting portion 11*b* are continuously formed with the intermediate cavity portion 11*c* and are increasingly spaced from each other.

Comparatively, each rim portion is extended at the side of the open end zone, thereby forming the wing-like flanges 11*g;* these flanges 11*g* are spaced a smaller distance from each other, when compared with the distance separating them, at the closed side of the plug-connecting portion 11*b*.

In such a structure, clogging of the head portion 5*a* into the intermediate cavity portion 11*c* is effectively prevented and the fitting of the plug 5 is properly carried out.

When the plug 5 is correctly fitted into the open end zone 11*d*, the plug head portion 5*a* is securely held in the circumferential direction by the flanges 11*g,* which have increased surfaces. This structure therefore increases the holding power and improves the resistance against vibration or oscillation.

From the point of view of the proper insertion of the head portion 5*a* and the resistance to vibrations, the distance between the respective flanges 11*g* is preferably kept shorter.

Figure 25:
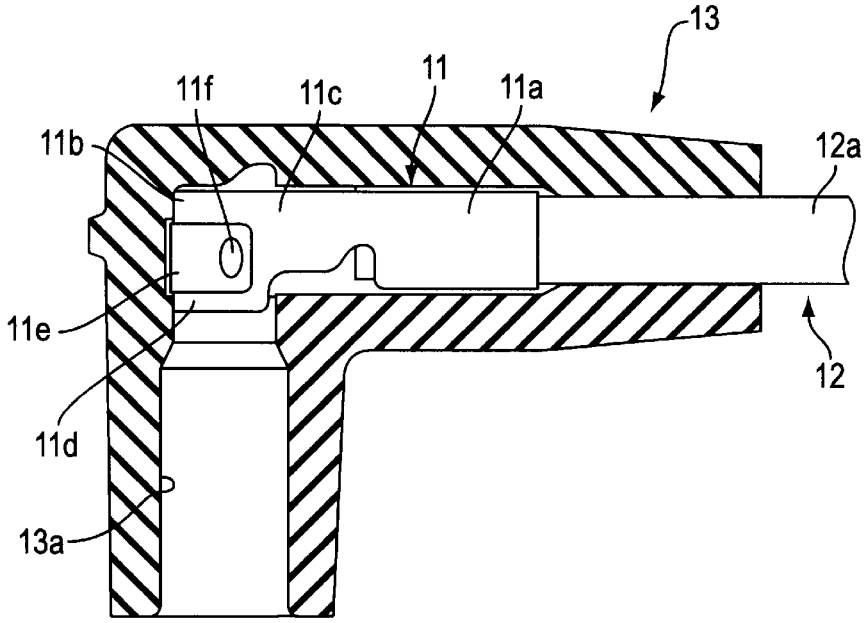
FIG. 25 shows a fifth embodiment of the socket terminal according to the invention.
Figure 26:
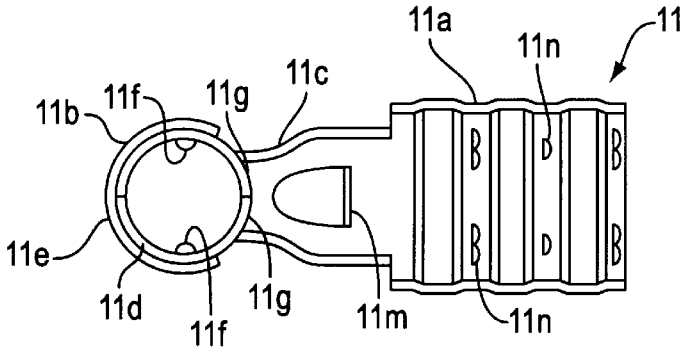
FIG. 26 shows a bottom plan view of the socket terminal of FIG. 25.

In some cases, the flanges 11*g* may form a closed loop, as shown in FIGS. 25 and 26. In this case, compared to the previous case, the head portion 5*a* is more efficiently prevented from inadvertent fitting into the intermediate cavity portion 11*c*. Proper insertion is also more easily effected. In addition, once the head portion 5*a* is fitted, it is still more securely held by the plug-connecting portion.

Figure 27:
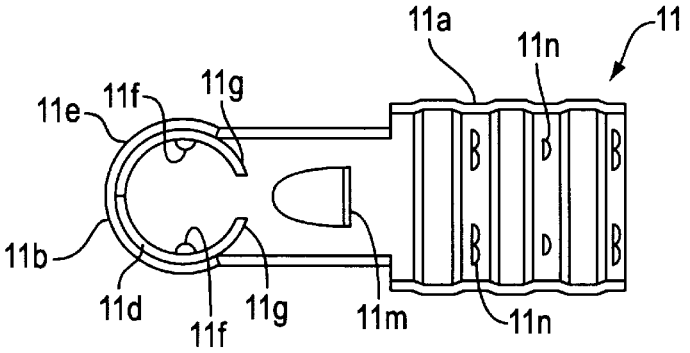
FIG. 27 shows a bottom plan view of the socket terminal according to a variant embodiment.

Alternatively, the socket terminal 11 may contain no intermediate cavity portion 11*c* as shown in FIG. 27. In this embodiment, the same effects and advantages as mentioned for the previous embodiments are obtained.

Figure 1:
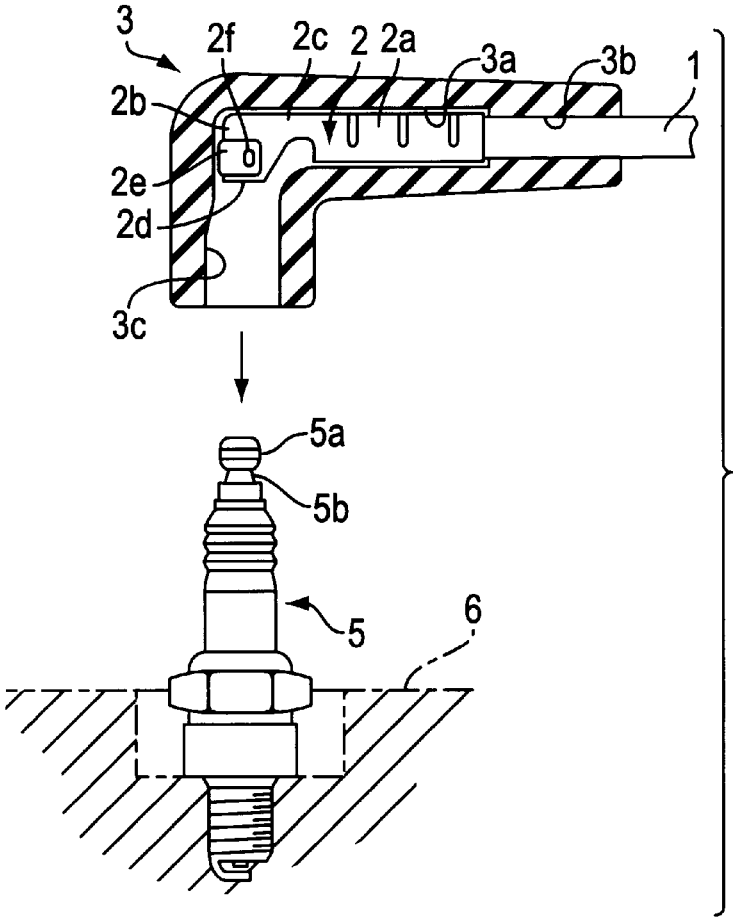
FIG. 1 (PRIOR ART)
FIG. 1 shows a side-elevational view of a known socket terminal when it is installed in an elastomeric boot in a known plug connection, and a side view of a spark plug.
Figure 2:
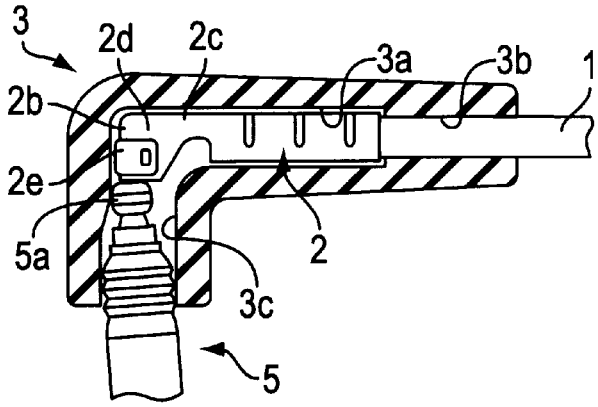
FIG. 2 (PRIOR ART)
FIGS. 2 and 3 show the head portion of a spark plug being inserted in an oblique direction into the known plug connection.
Figure 3:
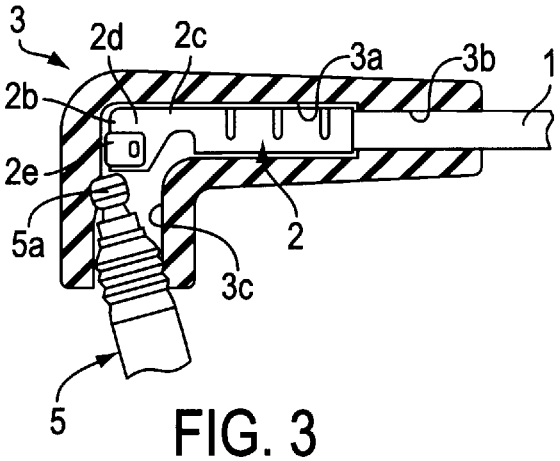
FIG. 3 (PRIOR ART)
Figure 4:
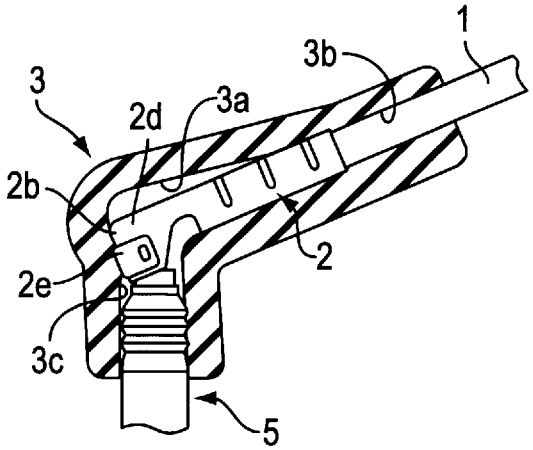
FIG. 4 (PRIOR ART)
FIG. 4 shows a side-elevational view of the plug connection of FIG. 1 when it is being unplugged.
Figure 5:
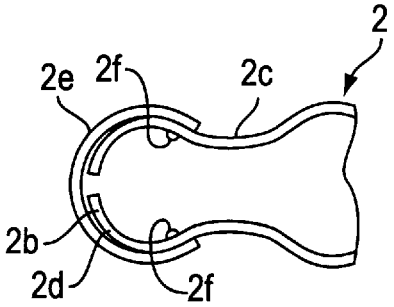
FIG. 5 (PRIOR ART)
FIG. 5 shows deformations of the socket terminal.
Figure 6:
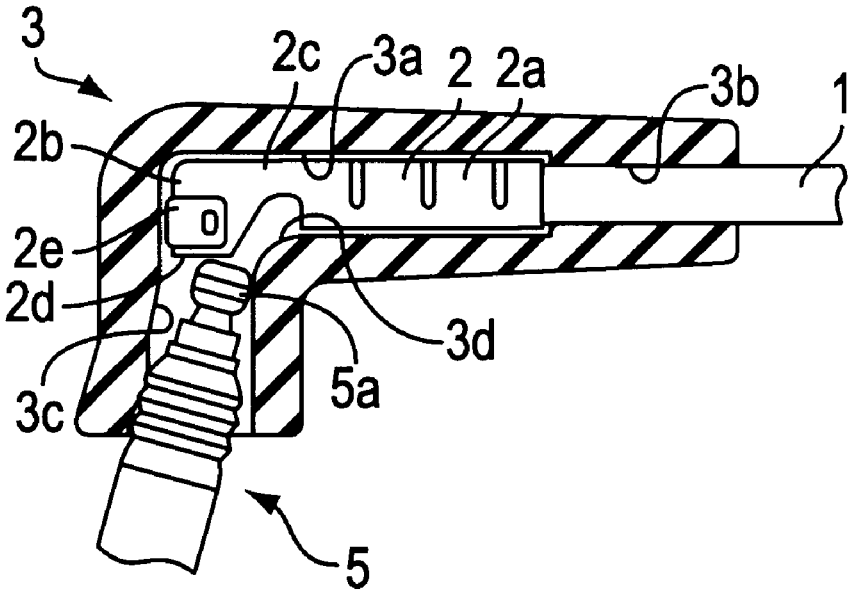
FIG. 6 (PRIOR ART)
FIG. 6 shows a side-elevational view of the plug connection of FIG. 1 when the head portion of the spark plug is directed towards the constricted portion.
Figure 7:
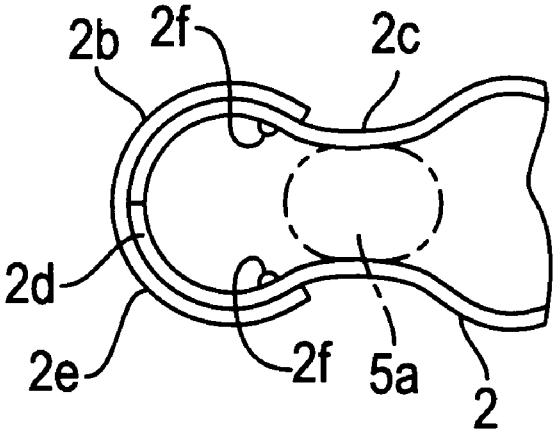
FIG. 7 (PRIOR ART)
FIG. 7 shows a bottom plan view of the head portion of the spark plug when it is hooked inside the constricted portion of the known plug connection of FIG. 1.

In the known boot 13, where the rim portions of the open end zone 2*d* are spaced apart (FIG. 5), the holding power is not sufficiently strong. Accordingly, vibration deteriorates the fixture and generates abrasion dust. These drawbacks are effectively eliminated by the above construction.

In addition, according to the present invention, the cable-connecting portion 11*a* may be provided with a stopper portion 11*m* for abutting against the cable core and positioning it, and with one or a plurality of protrusions 11*n,* formed by cutting and bending portions of the cable-connecting portion. The stopper portions and protrusions effectively immobilize the inserted cable (see FIG. 18).

The form and the structure of the socket terminal 11 and the elastomeric boot 13 may be adapted depending on the embodiments and modified as a function of the intended object, use and use location.

The elastomeric boot may be manufactured of silicone rubber or other elastic insulators, as in the prior art.

The plug connection according to the present invention may be used not only for connecting a spark plug to a high-voltage cable, but also for connecting an ignition coil or distributor to such a cable.

Although the invention has bee described with reference to particular means, materials and embodiments, it is to be understood that the invention is not limited to the particulars disclosed and extends to all equivalents within the scope of the claims.

The present disclosure relates to subject matter contained in priority Japanese Application Nos. HEI 8-304691, HEI 8-304692, and HEI 8-304693, all filed on Nov. 15, 1996, which are all herein expressly incorporated by reference in their entireties.

What is claimed:

1. An L-shaped plug connection for connecting a high-voltage cable to a spark plug, said plug connection comprising:

a socket terminal having a tubular cable-connecting portion having an inner diameter, a semi-tubular plug connecting portion extending in a perpendicular direction to said cable-connecting portion and having an open end zone, said open end zone having a wall thickness and a pair of opposed rim portions, and an intermediate cavity portion being provided therebetween and having a predetermined dimension in the transverse direction of said cable-connecting portion;

a C-shaped elastic ring;

an elastomeric boot having an L-shaped cavity including at least an inner face facing an outer face of said cable-connecting portion and a projecting inside corner at the intersection between said intermediate cavity portion and said rim portions and leaving a gap therebetween; and said plug connection comprising a plug-guiding arrangement being configured to enable smooth fitting to, and removal from, said spark plug, wherein said plug-guiding arrangement comprises a channel in said inner face of said L-shaped cavity at a position corresponding to the position of said elastic ring, whereby said channel receives said elastic ring and further includes a space sufficient to receive said elastic ring when it is expanded, such that said elastic ring engages said channel to resist displacement thereof during removal of said spark plug.

2. The L-shaped plug connection according to claim 1, wherein said plug-guiding arrangement further comprises a recess in said inner face of said L-shaped cavity at a position corresponding to the position of said open end zone, whereby said recess receives said wall thickness of said open end zone.

3. The L-shaped plug connection according to claim 1, wherein said plug-guiding arrangement comprises said intermediate cavity portion, said predetermined dimension being sufficiently great such that there is substantially no gap between said intermediate cavity portion and said projecting inside corner.

4. The L-shaped plug connection according to claim 2, wherein said plug-guiding arrangement comprises said intermediate cavity portion, said predetermined dimension being sufficiently great such that there is substantially no gap between said intermediate cavity portion and said projecting inside corner.

5. The L-shaped plug connection according to claim 3, wherein said predetermined dimension of the intermediate cavity portion is substantially the same length as an inner diameter of the cable-connecting portion.

6. The L-shaped plug connection according to claim 4, wherein said predetermined dimension of the intermediate cavity portion is substantially the same length as an inner diameter of the cable-connecting portion.

7. The L-shaped plug connection according to claim 1, wherein said projecting inside corner substantially forms a right angle.

8. The L-shaped plug connection according to claim 2, wherein said projecting inside corner substantially forms a right angle.

9. The L-shaped plug connection according to claim 3, wherein said projecting inside corner substantially forms a right angle.

10. The L-shaped plug connection according to claim 4, wherein said projecting inside corner substantially forms a right angle.

11. The L-shaped plug connection according to claim 1, wherein said plug-guiding arrangement comprises said pair of opposed rim portions which approach closer to each other in the direction of said projecting inside corner.

12. The L-shaped plug connection according to claim 1, comprising a further plug-guiding arrangement having said pair of opposed rim portions which approach closer to each other in the direction of said projecting inside corner.

13. The L-shaped plug connection according to claim 2, comprising a further plug-guiding arrangement having said pair of opposed rim portions which approach closer to each other in the direction of said projecting inside corner.

14. The L-shaped plug connection according to claim 1, wherein said plug-guiding arrangement comprises said pair of opposed rim portions which contact each other near the position of said projecting inside corner.

15. The L-shaped plug connection according to claim 1, comprising a further plug-guiding arrangement having said pair of opposed rim portions which contact each other near the position of said projecting inside corner.

16. The L-shaped plug connection according to claim 2, comprising a further plug-guiding arrangement having said pair of opposed rim portions which contact each other near the position of said projecting inside corner.

* * * * *